US011707161B2

(12) United States Patent
Eberle

(10) Patent No.: US 11,707,161 B2
(45) Date of Patent: Jul. 25, 2023

(54) FOOT SCRUBBER ASSEMBLY

(71) Applicant: Dion Eberle, Hague, ND (US)

(72) Inventor: Dion Eberle, Hague, ND (US)

( * ) Notice: Subject to any disclaimer, the term of this patent is extended or adjusted under 35 U.S.C. 154(b) by 210 days.

(21) Appl. No.: 17/003,381

(22) Filed: Aug. 26, 2020

(65) Prior Publication Data

US 2022/0061597 A1 Mar. 3, 2022

(51) Int. Cl.
*A47K 7/02* (2006.01)
*A47K 7/03* (2006.01)

(52) U.S. Cl.
CPC ..... *A47K 7/026* (2013.01); *A47K 7/03* (2013.01); *A47K 2201/00* (2013.01)

(58) Field of Classification Search
CPC ..... A47K 7/026; A47K 7/03; A47K 2201/00; A47K 7/02; A43B 5/08
USPC ..... 15/104.92
See application file for complete search history.

(56) References Cited

U.S. PATENT DOCUMENTS 3,548,439 A * 12/1970 Berst ..... A47K 7/026 15/104.92
5,321,867 A 6/1994 Probst
5,813,078 A 9/1998 Hogan, Sr.
6,223,379 B1 5/2001 Martin
2010/0088816 A1 4/2010 Rollins

* cited by examiner

*Primary Examiner* — Thomas Raymond Rodgers

(57) ABSTRACT

A foot scrubber assembly includes a block that is positionable on a floor of a shower. A pair of stops is each coupled to and extends upwardly from the block to define a foot space between the stops. A plurality of foot bristles is each coupled to and extends upwardly from the block to scrub a sole of the person's foot. A plurality of side bristles is each coupled to and extends away from a respective one of the stops to scrub the sides of the person's foot. A container is positioned in the block to contain a liquid soap. The container is comprised of a resiliently deformable material to be compressed by the person's foot. In this way the liquid soap can be urged outwardly from the container. The container is in fluid communication with the foot bristles to release the liquid soap into the foot bristles.

6 Claims, 6 Drawing Sheets

FOOT SCRUBBER ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to scrubber devices and more particularly pertains to a new scrubber device for scrubbing a person's foot when the person is showering.

BRIEF SUMMARY OF THE INVENTION

An embodiment of the disclosure meets the needs presented above by generally comprising a block that is positionable on a floor of a shower. A pair of stops is each coupled to and extends upwardly from the block to define a foot space between the stops. A plurality of foot bristles is each coupled to and extends upwardly from the block to scrub a sole of the person's foot. A plurality of side bristles is each coupled to and extends away from a respective one of the stops to scrub the sides of the person's foot. A container is positioned in the block to contain a liquid soap. The container is comprised of a resiliently deformable material to be compressed by the person's foot. In this way the liquid soap can be urged outwardly from the container. The container is in fluid communication with the foot bristles to release the liquid soap into the foot bristles.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
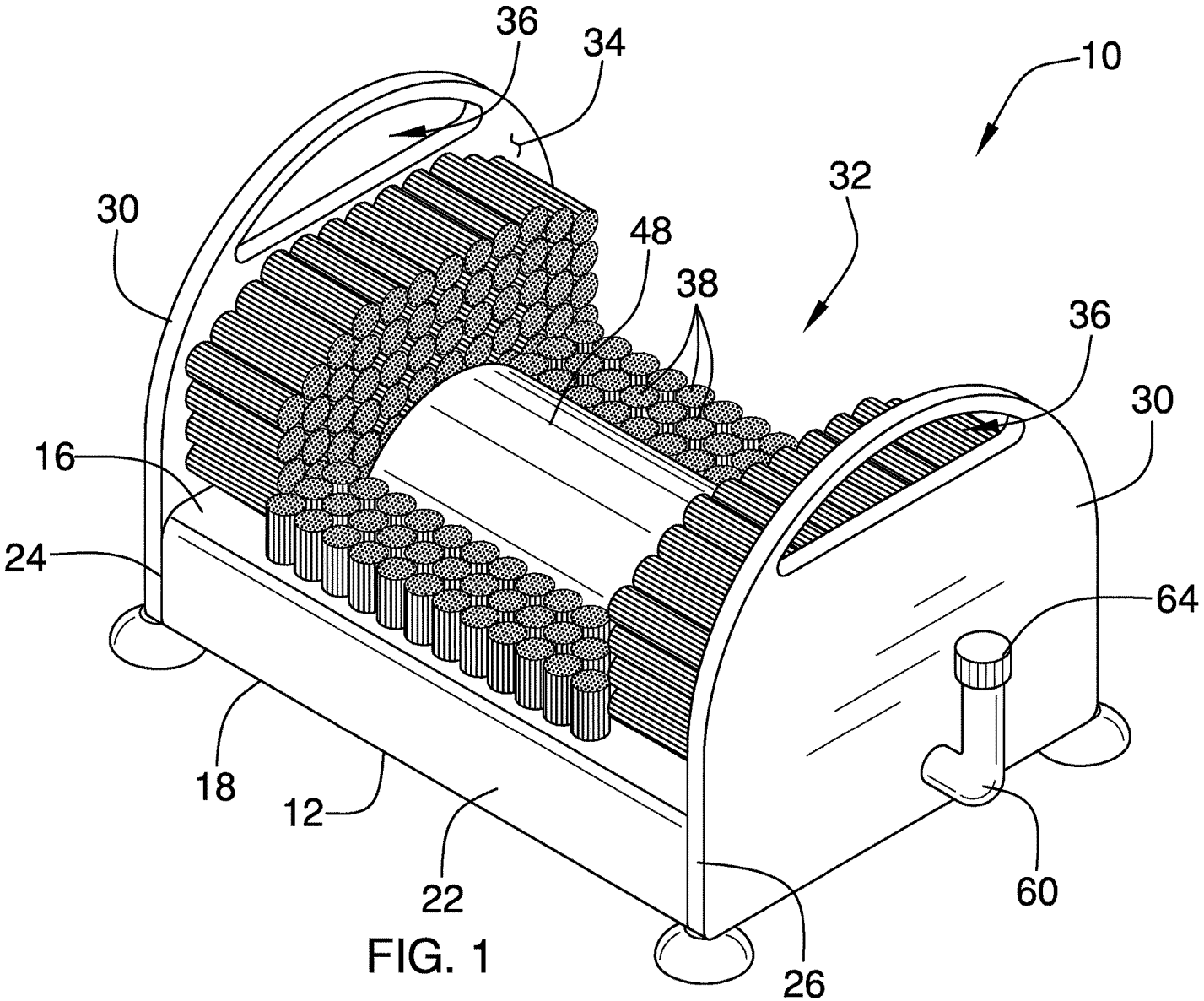
FIG. 1 is a top perspective view of a foot scrubber assembly according to an embodiment of the disclosure.
Figure 2:
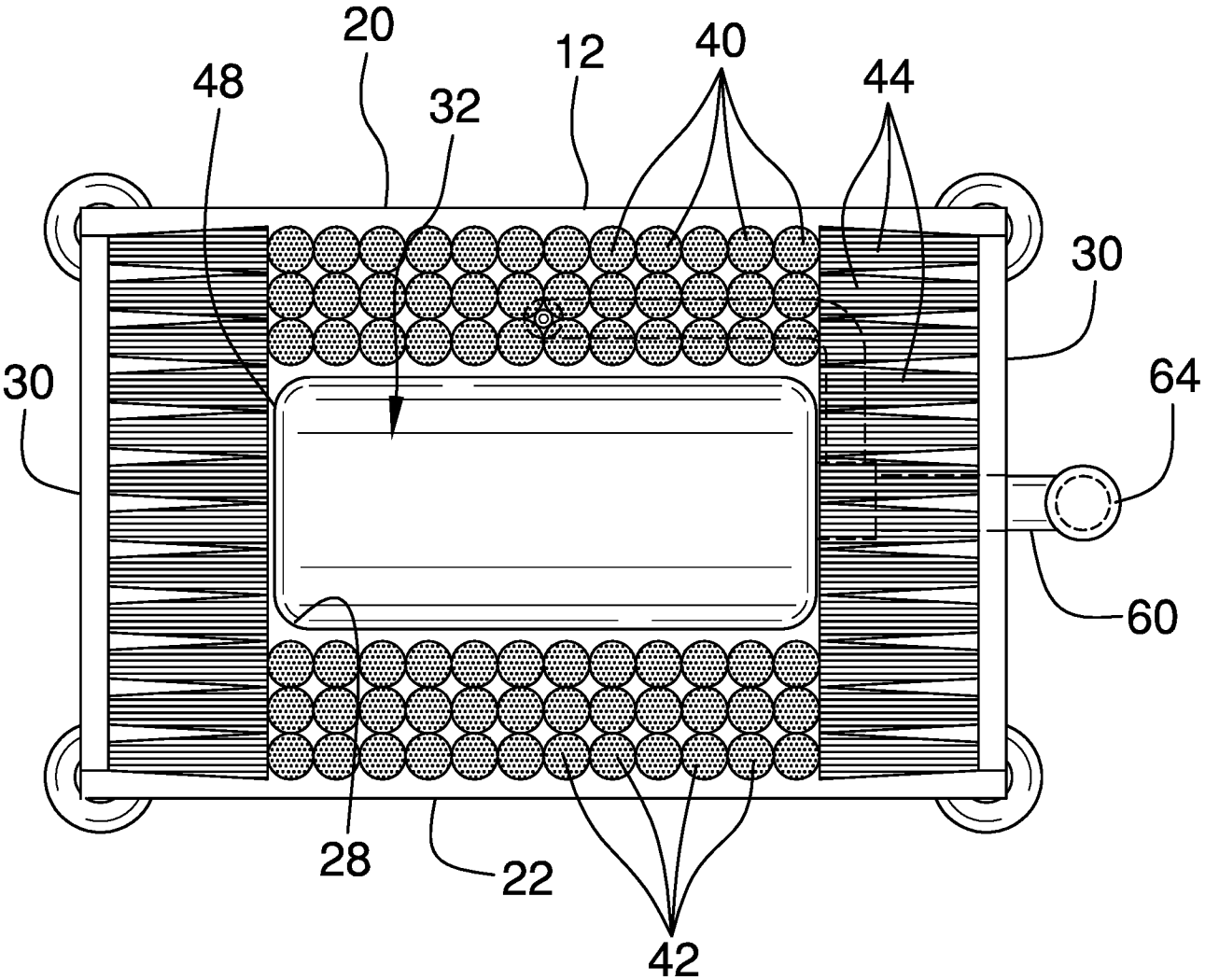
FIG. 2 is a top view of an embodiment of the disclosure.
Figure 3:
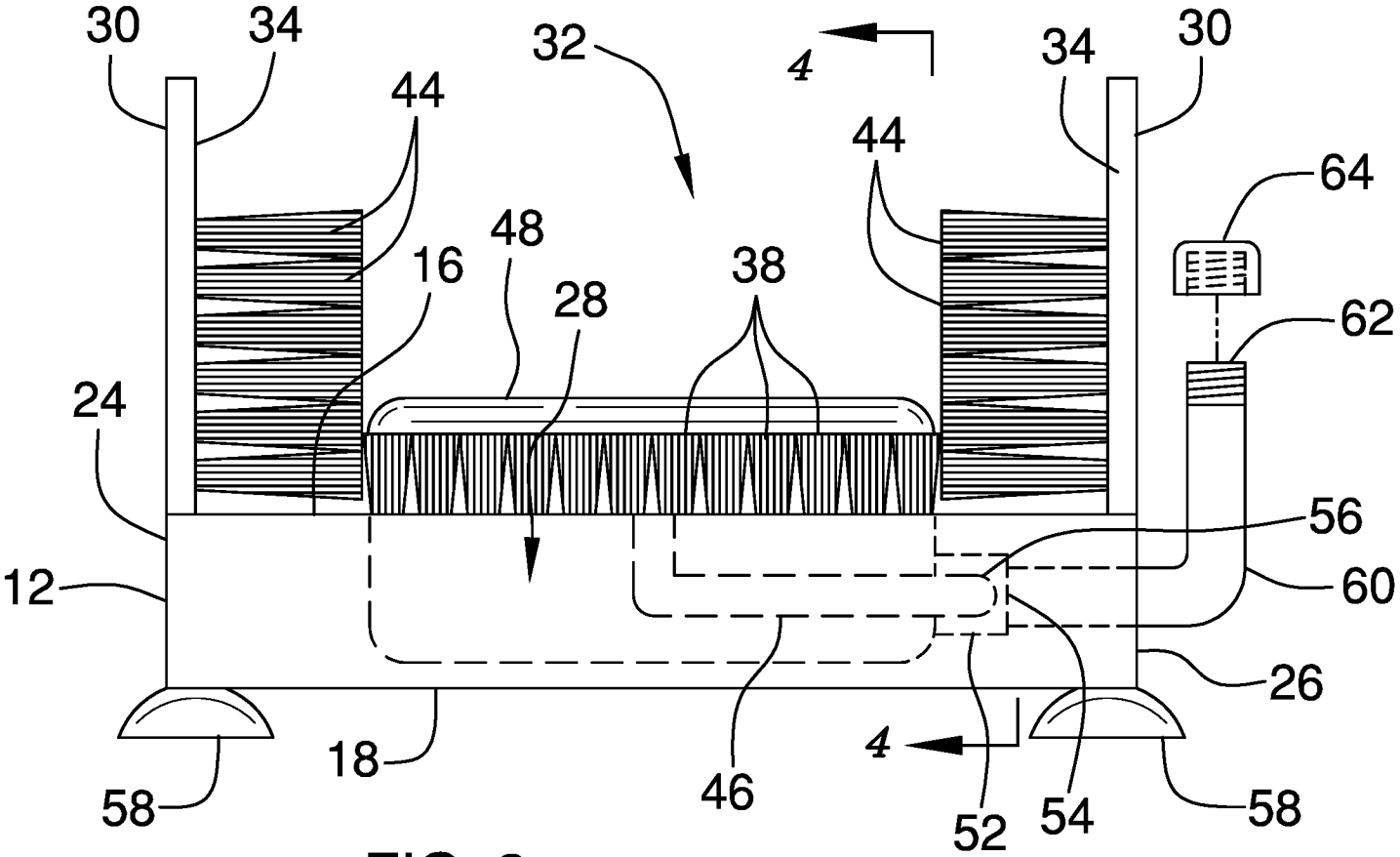
FIG. 3 is a front phantom view of an embodiment of the disclosure.
Figure 4:
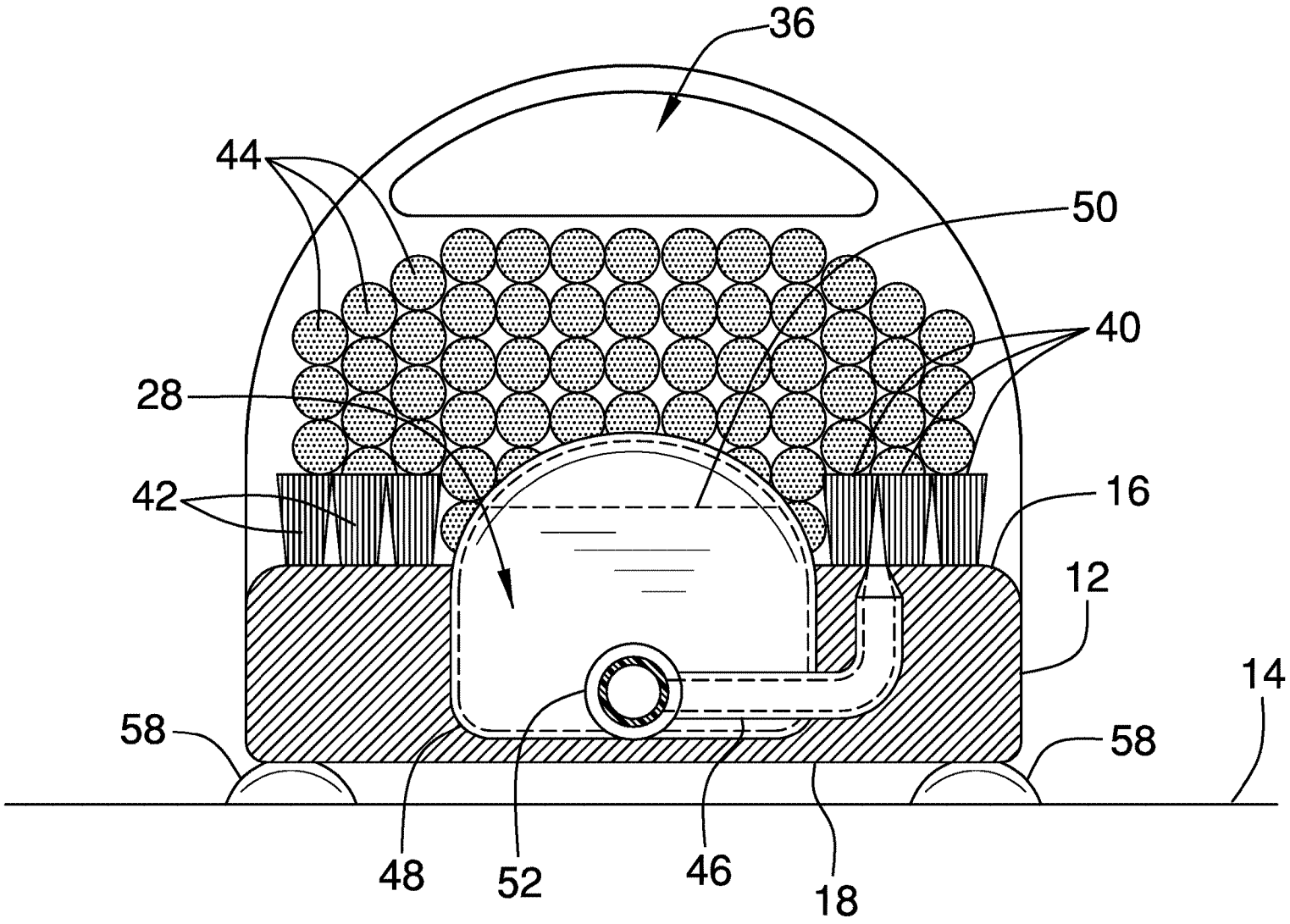
FIG. 4 is a cross sectional view taken along line 4-4 of FIG. 3 of an embodiment of the disclosure.
Figure 5:
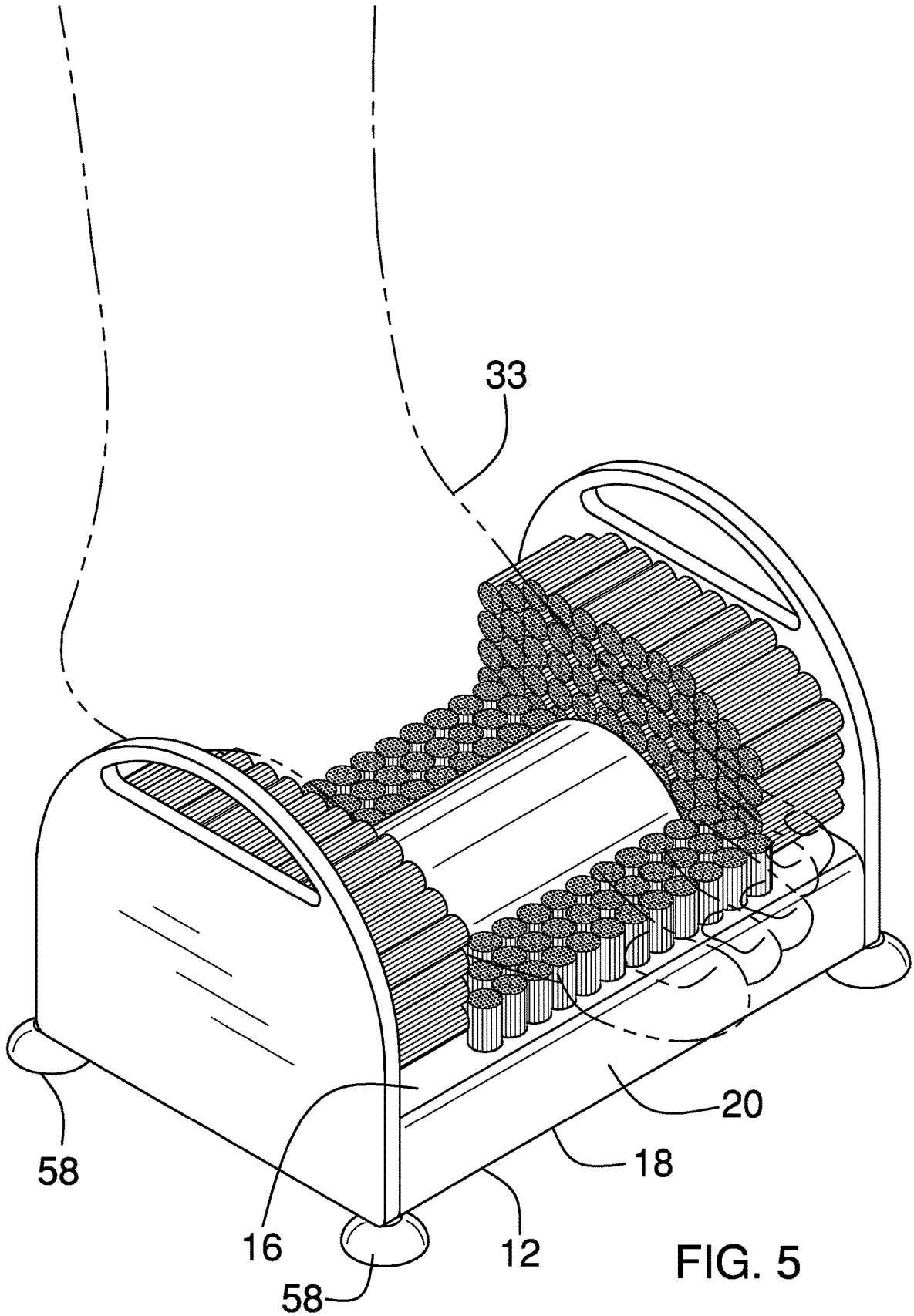
FIG. 5 is a perspective in-use view of an embodiment of the disclosure.

With reference now to the drawings, and in particular to FIGS. 1 through 6 thereof, a new scrubber device embodying the principles and concepts of an embodiment of the disclosure and generally designated by the reference numeral 10 will be described.

As best illustrated in FIGS. 1 through 6, the foot scrubber assembly 10 generally comprises a block 12 that is positionable on a floor 14 of a shower such that the block 12 is accessible to a person bathing in the shower. The block 12 has a top side 16, a bottom side 18, a front side 20, a back side 22, a first lateral side 24 and a second lateral side 26, and the top side 16 has a well 28 extending toward the bottom side 18. A pair of stops 30 is each coupled to and extends upwardly from the block 12 to define a foot space 32 between the stops 30. The foot space 32 can have the person's foot 33 positioned therein.

Each of the stops 30 has a first surface 34 and each of the stops 30 is positioned on a respective one of the first lateral side 24 and the second lateral side 26 of the block 12. Each of the stops 30 extends upwardly beyond the top side 16 of the block 12 having the first surface 34 of each of the stops 30 facing each other. Each of the stops 30 has an opening 36 extending through thereby facilitating the stops 30 to be gripped.

A plurality of foot bristles 38 is each coupled to and extends upwardly from the block 12 to scrub a sole of the person's foot 33. Each of the foot bristles 38 is positioned on the top side 16 of the block 12 and the foot bristles 38 is distributed over an entirety of the top side 16. The plurality of foot bristles 38 includes a set of toe bristles 40 being positioned between the well 28 and the front side 20 of the block 12. The plurality of foot bristles 38 includes a set of heel bristles 42 being positioned between the well 28 and the back side 22 of the block 12. The heel bristles 42 have greater stiffness than the toe bristles 40.

A plurality of side bristles 44 is each coupled to and extends away from a respective one of the stops 30 to scrub the sides of the person's foot 33. Each of the side bristles 44 is positioned on the first surface 34 of the respective stop 30. Additionally, each of the side bristles 44 extends into the foot space 32. A conduit 46 is integrated into the block 12 and the conduit 46 extends between the well 28 and the top side 16 of the block 12.

A container 48 is positioned in the block 12 to contain a liquid soap 50 and the container 48 is comprised of a resiliently deformable material. Thus, the container 48 can be compressed by the person's foot 33 thereby facilitating the liquid soap 50 to be urged outwardly from the container 48. The container 48 is positioned in the well 28 in the block 12 and the container 48 extends upwardly beyond the top side 16 of the block 12. The container 48 has a neck 52 thereon and the neck 52 has an input 54 and an output 56. The conduit 46 is fluidly coupled to the output 56 to route the liquid soap 50 onto the person's foot 33 when the person's foot 33 steps on the container 48 for washing the person's foot 33.

A plurality of mating members 58 is each coupled to the block 12. Each of the mating members 58 releasably engages the floor 14 of the shower thereby inhibiting the block 12 from sliding on the floor 14 of the shower. Each of the mating members 58 is positioned on the bottom side 18 of the block 12. Each of the mating members 58 may comprise a suction cup, hook and loop fasteners, water proof adhesive strips or any other type of water resistant mating member.

A fill pipe 60 is fluidly coupled to the container 48 to fill the container 48 with the liquid soap 50. The fill pipe 60 is fluidly coupled to the input 54 of the neck 52 on the container 48 and the fill pipe 60 extends outwardly through a respective one of the stops 30. The fill pipe 60 has a distal end 62 that is exposed with respect to the respective stop 30. A cap 64 is removably coupled to the fill pipe 60 for closing the fill pipe 60 and the cap 64 is positioned on the distal end 62 of the fill pipe 60.

Figure 6:
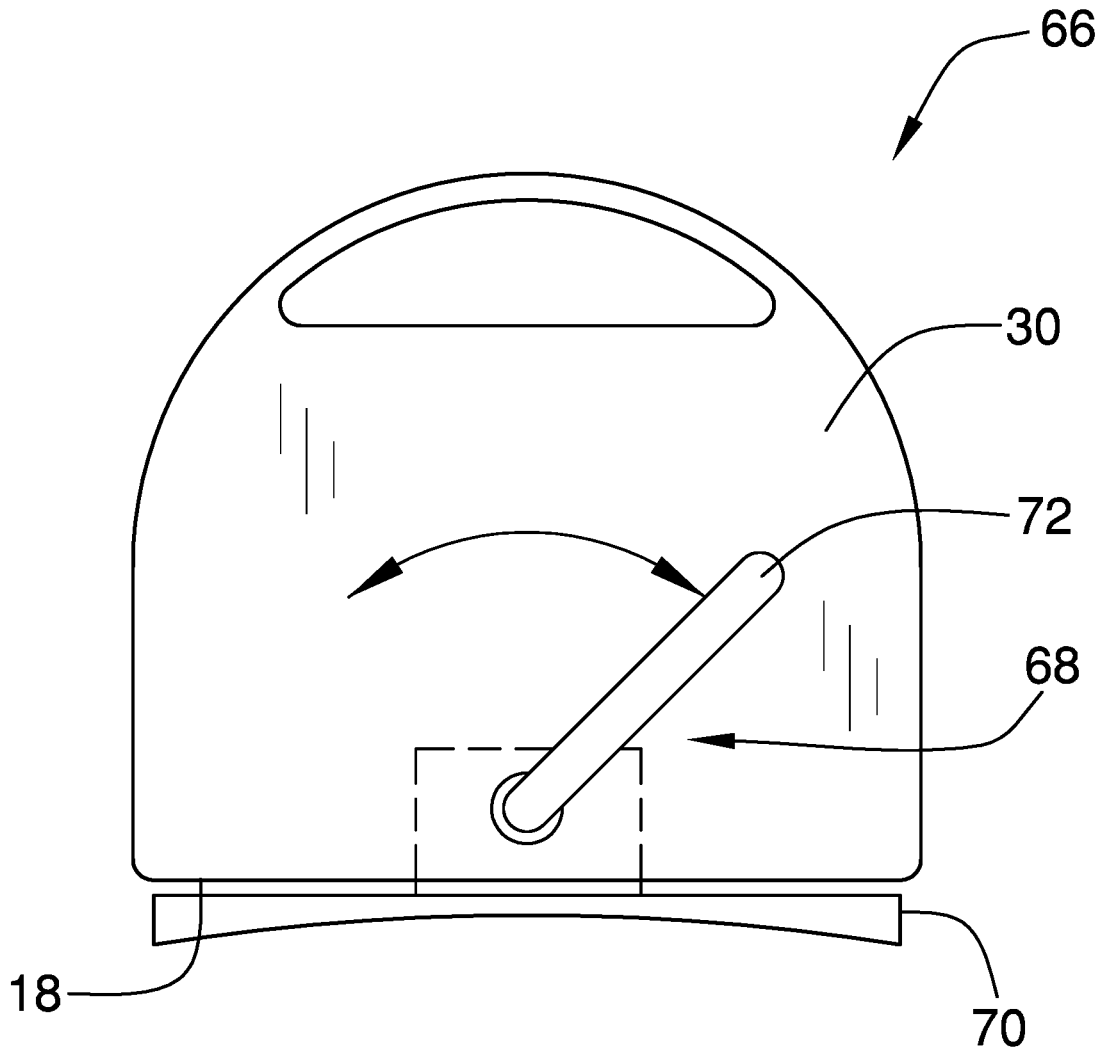
FIG. 6 is a perspective view of an alternative embodiment of the disclosure.

In an alternative embodiment 66 as shown in FIG. 6, an attachment mechanism 68 may be coupled to the bottom side 18 of the block 12. The attachment mechanism 68 may include a deformable pad 70 that is positioned on the bottom side 18 of the block 12 and a lever 72 that extends laterally away from the block 12. The lever 72 may urge the deformable pad 70 into a concave shape when the lever 72 is moved into a locking position. In this way the deformable pad 70 can suctionally engage floor 14 of the shower. The lever 72 may flatten the deformable pad 70 when the lever is moved into a releasing position to disengage the floor 14 of the shower.

In use, the container 48 is filled with the liquid soap 50 and the block 12 is positioned on the floor 14 of the shower. The person steps on the container 48 to compress the container 48 and subsequently urge the liquid soap 50 onto the foot bristles 38. The person rubs their foot 33 back and forth on the foot bristles 38 and the side bristles 44 for scrubbing their foot 33. In this way a person with limited mobility can wash their feet without bending over and without risking falling down in the shower.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foot scrubber assembly being configured to release soap onto a foot for scrubbing the foot, said assembly comprising:

a block being positionable on a floor of a shower wherein said block is configured to be accessible to a person bathing in the shower, wherein said block has a top side, a bottom side, a first lateral side and a second lateral side, said top side having a well extending toward said bottom side;

a pair of stops, each of said stops being coupled to and extending upwardly from said block to define a foot space between said stops wherein said foot space is configured to have the person's foot positioned therein;

a plurality of foot bristles, each of said foot bristles being coupled to and extending upwardly from said block wherein each of said foot bristles is configured to scrub a sole of the person's foot;

a plurality of side bristles, each of said side bristles being coupled to and extending away from a respective one of said stops wherein each of said side bristles is configured to scrub the sides of the person's foot; and a container being positioned in said block wherein said container is configured to contain a liquid soap, said container being comprised of a resiliently deformable material wherein said container is configured to be compressed by the person's foot thereby facilitating the liquid soap to be urged outwardly from said container, said container being in fluid communication with said foot bristles wherein said container is configured to release the liquid soap into said foot bristles, wherein said container is positioned in said well in said block, said container extending upwardly beyond said top side of said block;

a conduit being integrated into said block, said conduit extending between said well and said top side of said block;

wherein said container has a neck thereon, said neck having an input and an output, said output having said conduit being fluidly coupled thereto wherein said conduit is configured to route the liquid soap onto the person's foot when the person's foot steps on said container for washing the person's foot; and a fill pipe being fluidly coupled to said input of the neck, wherein said fill pipe is configured to fill said container with the liquid soap, said fill pipe being fluidly coupled to said input of said neck on said container, said fill pipe extending outwardly through a respective one of said stops, said fill pipe having a distal end being exposed with respect to said respective stop.

2. The assembly according to claim 1, wherein each of said stops has a first surface, each of said stops being positioned on a respective one of said first lateral side and said second lateral side of said block, each of said stops extending upwardly beyond said top side of said block having said first surface of each of said stops facing each other.

3. The assembly according to claim 2, wherein each of said side bristles is positioned on said first surface of said respective stop, each of said side bristles extending into said foot space.

4. The assembly according to claim 1, further comprising a plurality of mating members, each of said mating members being coupled to said block wherein each of said mating members is configured to releasably engage the floor of the shower thereby inhibiting said block from sliding on the floor of the shower, each of said mating members being positioned on said bottom side of said block.

5. The assembly according to claim 1, further comprising a cap being removably coupled to said fill pipe for closing said fill pipe, said cap being positioned on said distal end of said fill pipe.

6. A foot scrubber assembly being configured to release soap onto a foot for scrubbing the foot, said assembly comprising:

a block being positionable on a floor of a shower wherein said block is configured to be accessible to a person bathing in the shower, said block having a top side, a bottom side, a first lateral side and a second lateral side, said top side having a well extending toward said bottom side;

a pair of stops, each of said stops being coupled to and extending upwardly from said block to define a foot space between said stops wherein said foot space is configured to have the person's foot positioned therein, each of said stops having a first surface, each of said stops being positioned on a respective one of said first lateral side and said second lateral side of said block, each of said stops extending upwardly beyond said top side of said block having said first surface of each of said stops facing each other;

a plurality of foot bristles, each of said foot bristles being coupled to and extending upwardly from said block wherein each of said foot bristles is configured to scrub a sole of the person's foot, each of said foot bristles being positioned on said top side of said block;

a plurality of side bristles, each of said side bristles being coupled to and extending away from a respective one of said stops wherein each of said side bristles is configured to scrub the sides of the person's foot, each of said side bristles being positioned on said first surface of said respective stop, each of said side bristles extending into said foot space;

a conduit being integrated into said block, said conduit extending between said well and said top side of said block;

a container being positioned in said block wherein said container is configured to contain a liquid soap, said container being comprised of a resiliently deformable material Wherein said container is configured to be compressed by the person's foot thereby facilitating the liquid soap to be urged outwardly from said container, said container being positioned in said well in said block, said container extending upwardly beyond said top side of said block, said container having a neck thereon, said neck having an input and an output, said output having said conduit being fluidly coupled thereto wherein said conduit is configured to route the liquid soap onto the person's foot when the person's foot steps on said container for washing the person's foot;

a plurality of mating members, each of said mating members being coupled to said block wherein each of said mating members is configured to releasably engage the floor of the shower thereby inhibiting said block from sliding on the floor of the shower, each of said mating members being positioned on said bottom side of said block;

a fill pipe being fluidly coupled to said input of the neck, wherein said fill pipe is configured to fill said container with the liquid soap, said fill pipe being fluidly coupled to said input of said neck on said container, said fill pipe extending outwardly through a respective one of said stops, said fill pipe having a distal end being exposed with respect to said respective stop; and a cap being removably coupled to said fill pipe for closing said fill pipe, said cap being positioned on said distal end of said fill pipe.

* * * * *